US006565180B2

(12) United States Patent
Yu et al.

(10) Patent No.: US 6,565,180 B2
(45) Date of Patent: May 20, 2003

(54) INK JET PRINTER WITH A COMPENSATION FUNCTION FOR MALFUNCTIONING NOZZLES

(75) Inventors: Chia-Lei Yu, Tao-Yuan Hsien (TW); Chien-Hsien Ho, I-Lan (TW)

(73) Assignee: BenQ Corporation, Taoyuan (TW)

( * ) Notice: Subject to any disclaimer, the term of this patent is extended or adjusted under 35 U.S.C. 154(b) by 4 days.

(21) Appl. No.: 09/683,645

(22) Filed: Jan. 29, 2002

(65) Prior Publication Data

US 2002/0060707 A1 May 23, 2002

(30) Foreign Application Priority Data

Feb. 15, 2001 (TW) ..... 90103481 A

(51) Int. Cl.[7] ..... B41J 29/393; B41J 29/38
(52) U.S. Cl. ..... 347/19; 347/14
(58) Field of Search ..... 347/19, 14, 12, 347/15, 23, 16, 5, 10, 11, 8, 20

(56) References Cited

U.S. PATENT DOCUMENTS 5,124,720 A * 6/1992 Schantz ..... 347/19
5,534,895 A * 7/1996 Lindenfelser et al. ..... 347/19
6,217,144 B1 * 4/2001 Myung ..... 347/19
6,447,091 B1 * 9/2002 Calvo et al. ..... 347/19

* cited by examiner

*Primary Examiner*—Craig Hallacher
*Assistant Examiner*—Charles W. Stewart, Jr.
(74) *Attorney, Agent, or Firm*—Winston Hsu

(57) ABSTRACT

An ink jet printer has an ink jet printing head with a plurality of nozzles, an ink jet compensation controlling device for driving the ink jet printing head, and a detecting device for detecting a status of the nozzles. When the detecting device detects at least one malfunctioning nozzle, the ink jet compensation controlling device selects a group of normal nozzles according to the position of the malfunctioning nozzle and controls the group of normal nozzles to form corresponding printing strips on the document. The printing strips formed by the normal nozzles cover an area of the printing strips normally formed by the malfunctioning nozzle.

16 Claims, 15 Drawing Sheets

INK JET PRINTER WITH A COMPENSATION FUNCTION FOR MALFUNCTIONING NOZZLES

BACKGROUND OF INVENTION

1. Field of the Invention

The present invention relates to an ink jet printer, and more particularly, to an ink jet printer with a compensation function for malfunctioning nozzles.

2. Description of the Prior Art

In general, ink jet printers comprise one or more ink jet printing heads, and each ink jet printing head comprises a plurality of nozzles. The ink jet printers utilize the nozzles to jet ink to print documents. However, due to a demand by users to increase print quality, the ink jet printers must have increased printing resolution. So, the size of the nozzles must be reduced, but this increases a probability of foreign materials building up on the nozzles.

Please refer to FIG. 1 and FIG. 2. FIG. 1 is a diagram of a prior art ink jet printer 10. FIG. 2 is a printing diagram of the ink jet printer 10 shown in FIG. 1, when operating properly. The ink jet printer 10 comprises an ink jet printing head 12. The ink jet printing head 12 moves back and forth along an ink jet track 13 to print a document 11. The ink jet printing head 12 comprises a plurality of nozzles 14*a* and 14*b* for jetting ink needed when printing to form a plurality of printing strips 16 and 19 on the document 11. Each printing strip 16 or 19 is made of a plurality of ink jet spots 18.

The ink jet printer 10 uses a popular printing method called shingling. The shingling printing method is performed by using N-printing routes to print a printing area. In the first printing route, only 1/N nozzles of total nozzles are used to jet ink. In the second printing route, another 1/N nozzles of total nozzles are used to print. This is repeated to perform N-printing routes to finish printing the printing area with nozzles at different positions. As shown in FIG. 2, in the first printing route of the ink jet printing head 12, only half of the nozzles 14*a*, shown in FIG. 2, are used to form the printing strips 16. In the second printing route, the other half of the nozzles 14*b* are used to form the printing strips 19. The nozzles 14*a* or 14*b* are used separately, at different positions, to form the interlaced printing strips 16 and 19 to finish the printing operation. Again, FIG. 2 is only a preferred embodiment of shingling printing. Actually, there are many methods of shingling printing, but this printing method is obvious to those skilled in the art, so further details are omitted.

Please refer to FIG. 3. FIG. 3 is a printing diagram of the ink jet printer 10 shown in FIG. 2, when having a malfunctioning nozzle 15. In general, nozzles are often damaged by some reason (such as blockage by a foreign matter), so that they cannot jet ink properly. As shown in FIG. 3, when the ink jet printing head 12 comprises a malfunctioning nozzle 15, because the malfunctioning nozzle 15 cannot jet ink properly, if printing with the above method, there is a blank space 17 formed on the document 11, and the printing quality is affected.

Please refer to FIG. 4. FIG. 4 is another printing diagram of a prior art ink jet printer when operating properly. The ink jet printer 20 also comprises an ink jet printing head 22, and the printing head comprises a plurality of nozzles 24 to jet ink to form a plurality of printing strips 26 on a document 21. The printing method used in the ink jet printer 20 is different from the above printing method of shingling, and it is a printing method of area printing. The ink jet printing head 22 executes a plurality of printing processes to form an area by moving. It prints an area each time to form a plurality of printing areas 29 on the document 21 to finish the printing job of the entire document. In every printing process, the relative position between the ink jet printing head 22 and the document 21 changes. As shown in FIG. 4, labels I, II, and III of FIG. 4 represent the changes of positions of the ink jet printing head 22 relative to the document 21 in three successive printing processes. Therefore, by changing the relative positions, the ink jet printing head 22 is capable of performing printing at different positions on the document 21.

Please refer to FIG. 5. FIG. 5 is a printing diagram of the ink jet printer 20 shown in FIG. 4, when having a malfunctioning nozzle 25. As shown in FIG. 5, the ink jet printing head 22 comprises a malfunctioning nozzle 25. When the ink jet printing head 22 prints on the document 21, because the malfunctioning nozzle 25 cannot jet ink properly, each printing area 29 formed by the ink jet printing head 22 has a blank space. Therefore, when printing by the method of area printing, the printing quality of the ink jet printer 20 is also affected, because of the existence of the malfunctioning nozzle 25.

SUMMARY OF INVENTION

It is therefore a primary objective of the claimed invention to provide an ink jet printer with a compensation function for malfunctioning nozzles to solve the above mentioned problems.

According to claimed invention, the ink jet printer comprises an ink jet printing head having a plurality of nozzles. The ink jet printer also has an ink jet compensation controlling device for driving the ink jet printing head, so that the nozzles are capable of forming a plurality of linear printing strips on the document, each printing strip comprising a plurality of points. The ink jet printer also has a detecting device for detecting a working status of the nozzles. When the nozzles work normally, the ink jet compensation controlling device uses the nozzles to form the printing strips. If the detecting device detects at least one malfunctioning nozzle in the nozzles, the ink jet compensation controlling device selects a group of normal nozzles according to the position of the malfunctioning nozzle. The group of normal nozzles comprises a plurality of normal nozzles that excludes the malfunctioning nozzle. The detecting device then controls the group of normal nozzles to form printing strips on the document that correspond to strips that would normally have been printed by the malfunctioning nozzle.

It is an advantage of the claimed invention that the ink jet printer uses other nozzles operating properly to perform the printing operation of the document when there is a malfunctioning nozzle in the ink jet printing head of the ink jet printer.

These and other objectives and advantages of the claimed invention will no doubt become obvious to those of ordinary skill in the art after having read the following detailed description of the preferred embodiment that is illustrated in the various figures and drawings.

DETAILED DESCRIPTION

The present invention mainly replaces malfunctioning nozzles with properly operating nozzles and use changes of arrangement of printing to achieve printing quality and save cost.

Figure 6:
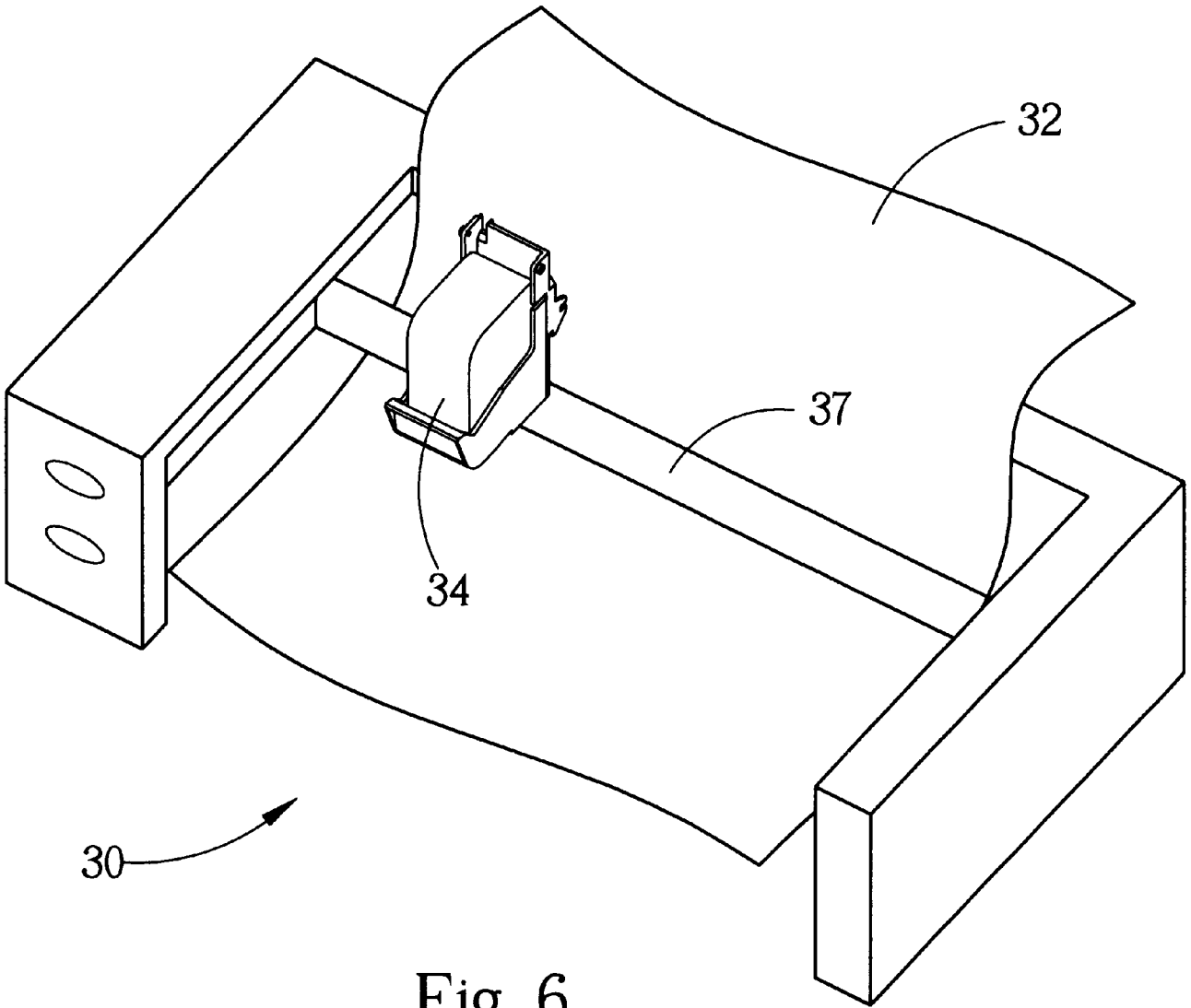
FIG. 6 is a diagram of a first preferred embodiment of the present invention ink jet printer.
Figure 7:
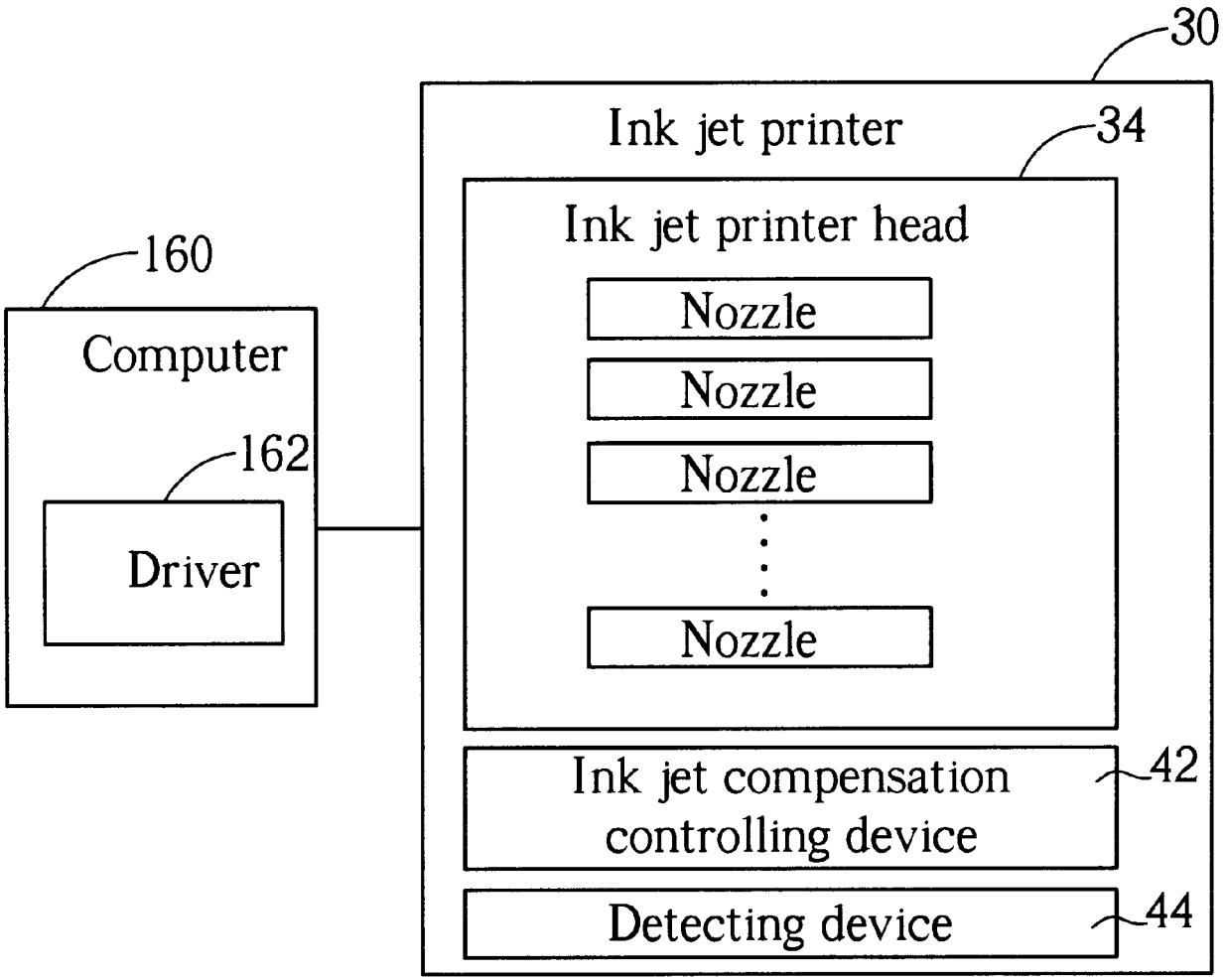
FIG. 7 is a function block diagram of the ink jet printer shown in FIG. 6.

Please refer to FIG. 6 and FIG. 7. FIG. 6 is a diagram of a first preferred embodiment of the present invention ink jet printer 30. FIG. 7 is a function block diagram of the ink jet printer 30 shown in FIG. 6. The ink jet printer 30 is used to print a document 32. The ink jet printer 30 comprises an ink jet printing head 34, an ink jet compensation controlling device 42, and a detecting device 44. The ink jet printer 30 is electrically connected to a computer 160. The computer 160 comprises a driver 162 for controlling the ink jet compensation controlling device 42 to print the document 32. The ink jet compensation controlling device 42 drives the ink jet printing head 34 moving along an ink jet track 37 back and forth to perform a plurality of printing processes. The ink jet printing head 34 comprises a plurality of nozzles for jetting ink to print the document 32. The detecting device 44 is used to detect the operating status of the nozzles to know if they can jet ink properly. Methods of detecting an operating status of the nozzles are obvious to those skilled in the art. Please refer to U.S. Pat. No. 5,182,580 for more detailed information. Further details are omitted here.

Figure 8:
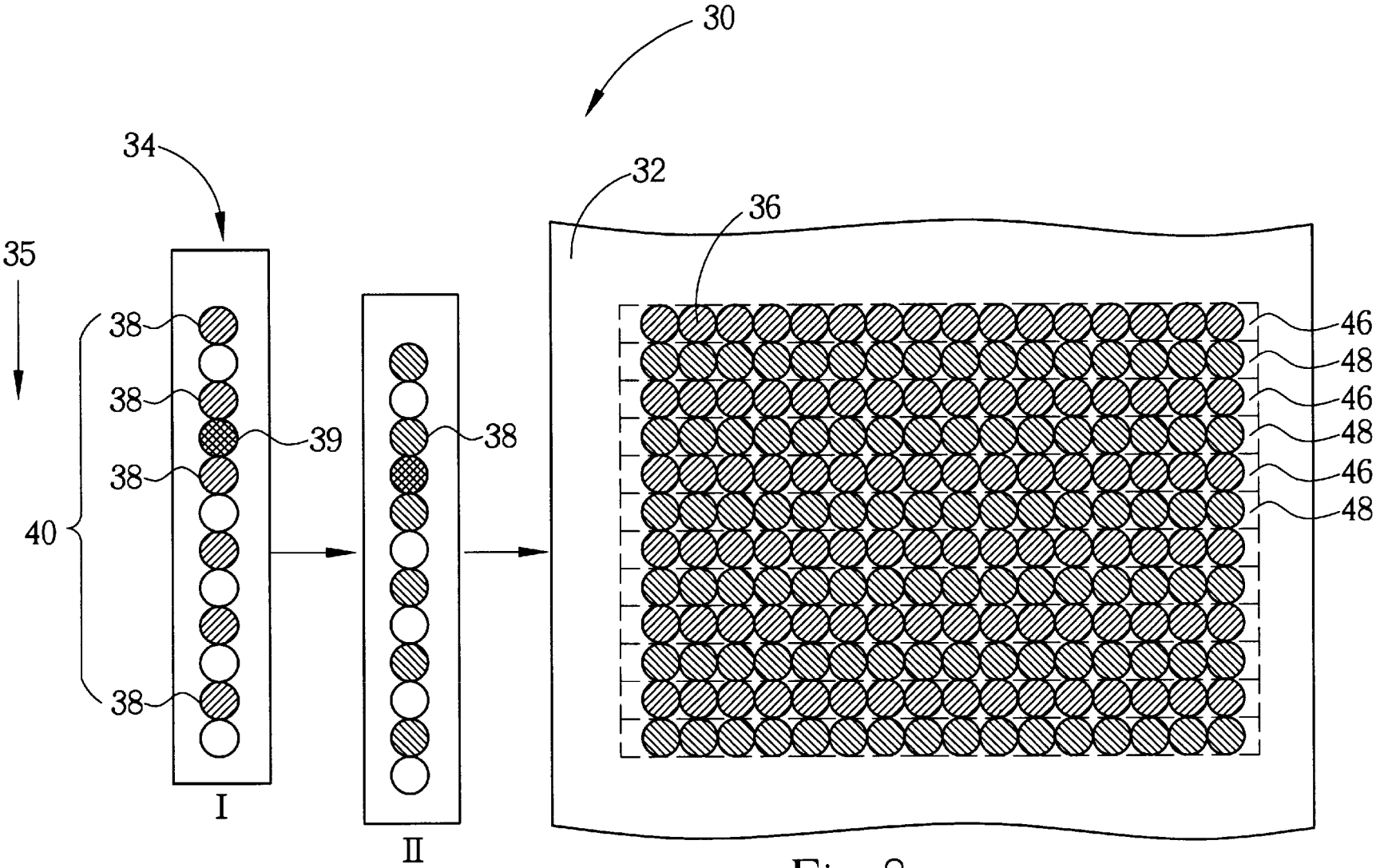
FIG. 8 is a printing diagram of the ink jet printer shown in FIG. 6.

Please refer to FIG. 8. FIG. 8 is a printing diagram of the ink jet printer 30 shown in FIG. 6. When all nozzles operate properly, the ink jet printer 30 uses the prior art printing method to print the document 32 (please refer to the above mentioned description of the prior art). A difference between the present invention ink jet printer 30 and the prior art is when the detecting device 44 detects a malfunctioning nozzle 39 (depicted by meshed strips), the ink jet compensation controlling device 42 selects a normal nozzle 38 from the group of normal nozzles 40 to replace the malfunctioning nozzle 39. Printing jobs are then performed by the present invention printing arrangement method described as follows.

As shown in FIG. 8, when the detecting device 44 detects the malfunctioning nozzle 39, the ink jet compensation controlling device 42 selects the normal nozzles 38 to form the group of normal nozzles 40, for example, by selecting every other nozzle. The group of normal nozzles 40 comprises a plurality of normal nozzles 38 excluding the malfunctioning nozzle 39. For this example, because of selecting every other nozzle, the number of normal nozzles 38 in the group of normal nozzles 40 is about half of the total nozzles. Then, the ink jet compensation controlling device 42 performs a plurality of printing processes with the group of normal nozzles 40 to form a plurality of printing strips 46 and 48 on the document 32, and each printing strip 46 or 48 comprises a plurality of ink jet points 36. In the printing process, the ink jet compensation controlling device 42 changes a relative position of the ink jet printing head 34 with the document 32 in a direction that is perpendicular to the printing strips 35 so that the group of normal nozzles 40 form the printing strips that are formed by the malfunctioning nozzle when the malfunctioning nozzle works properly. As shown in FIG. 8, when performing the first printing process, the ink jet compensation controlling device 42 moves the document 32, so that the ink jet printing head 34 locates to a position I and forms the printing strips 46 with the group of normal nozzles 40. When performing the second printing process, the ink jet compensation controlling device 42 still performs the printing process with the same group of normal nozzles 40, not using the group of nozzles with the malfunctioning nozzle 39 to perform printing as the prior art shingling method (please refer to FIG. 3) would. It moves the ink jet printing head 34, or the document 32, a fixed distance so that the ink jet printing head 34 locates to a position II and forms the printing strips 48 with the group of normal nozzles 40, and the printing strips 48 interlace the printing strips 46. For this example, it is better to move the ink jet printing head 34, or the document 32, a distance of odd numbers of nozzles, because the nozzle are selected every other nozzle here.

Figure 1:
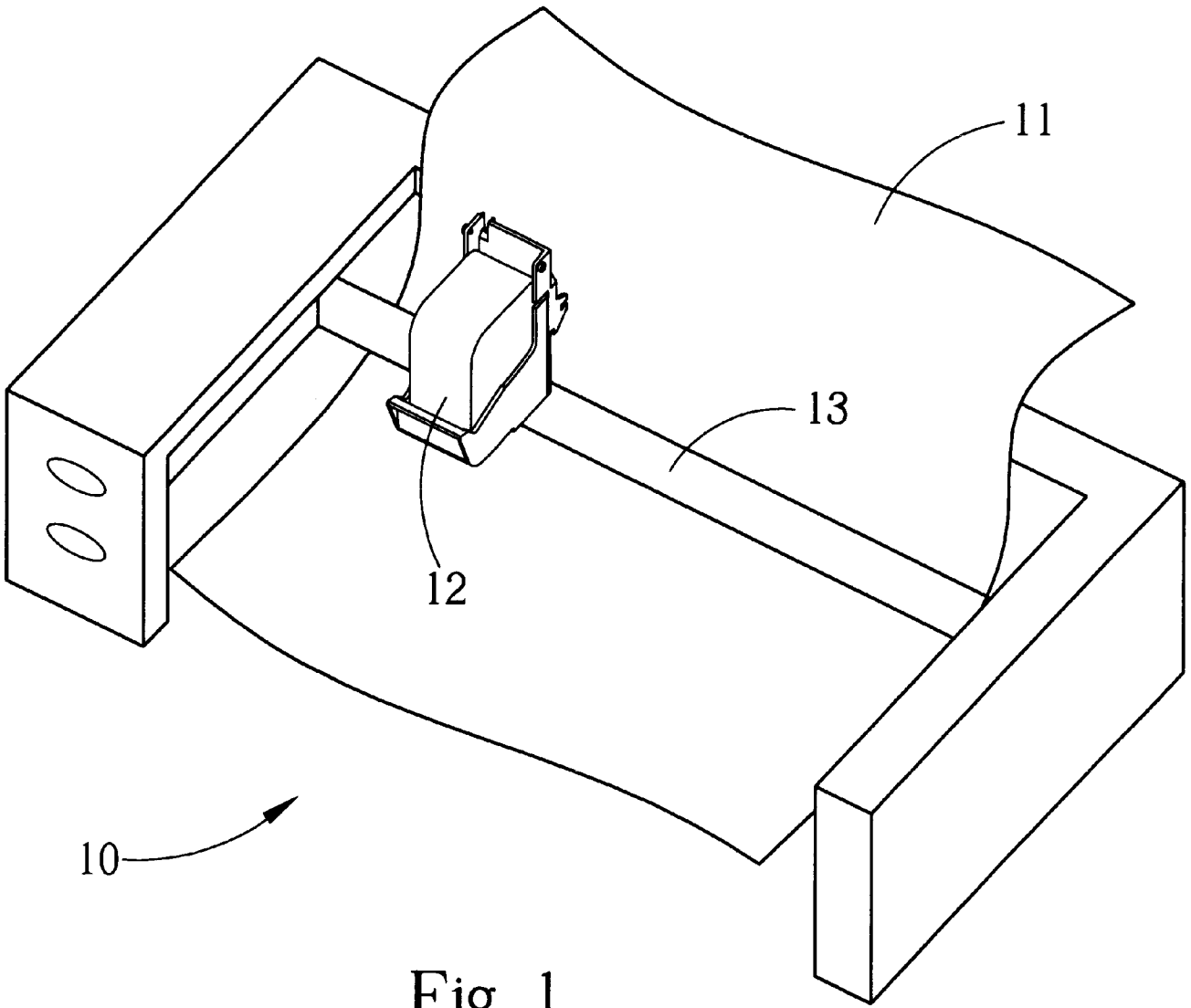
FIG. 1 is a diagram of a prior art ink jet printer.
Figure 2:
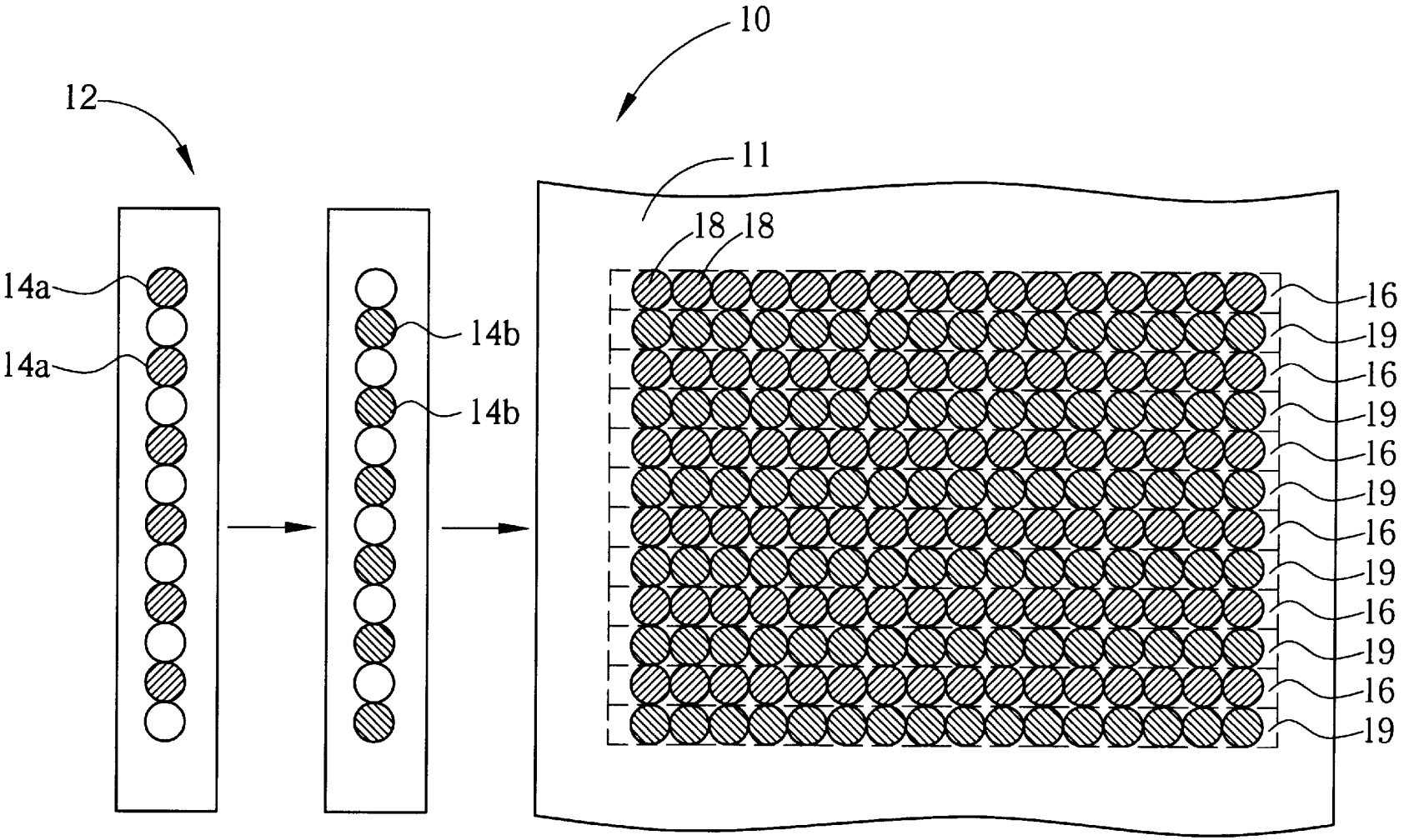
FIG. 2 is a printing diagram of the ink jet printer shown in FIG. 1 when operating properly.
Figure 3:
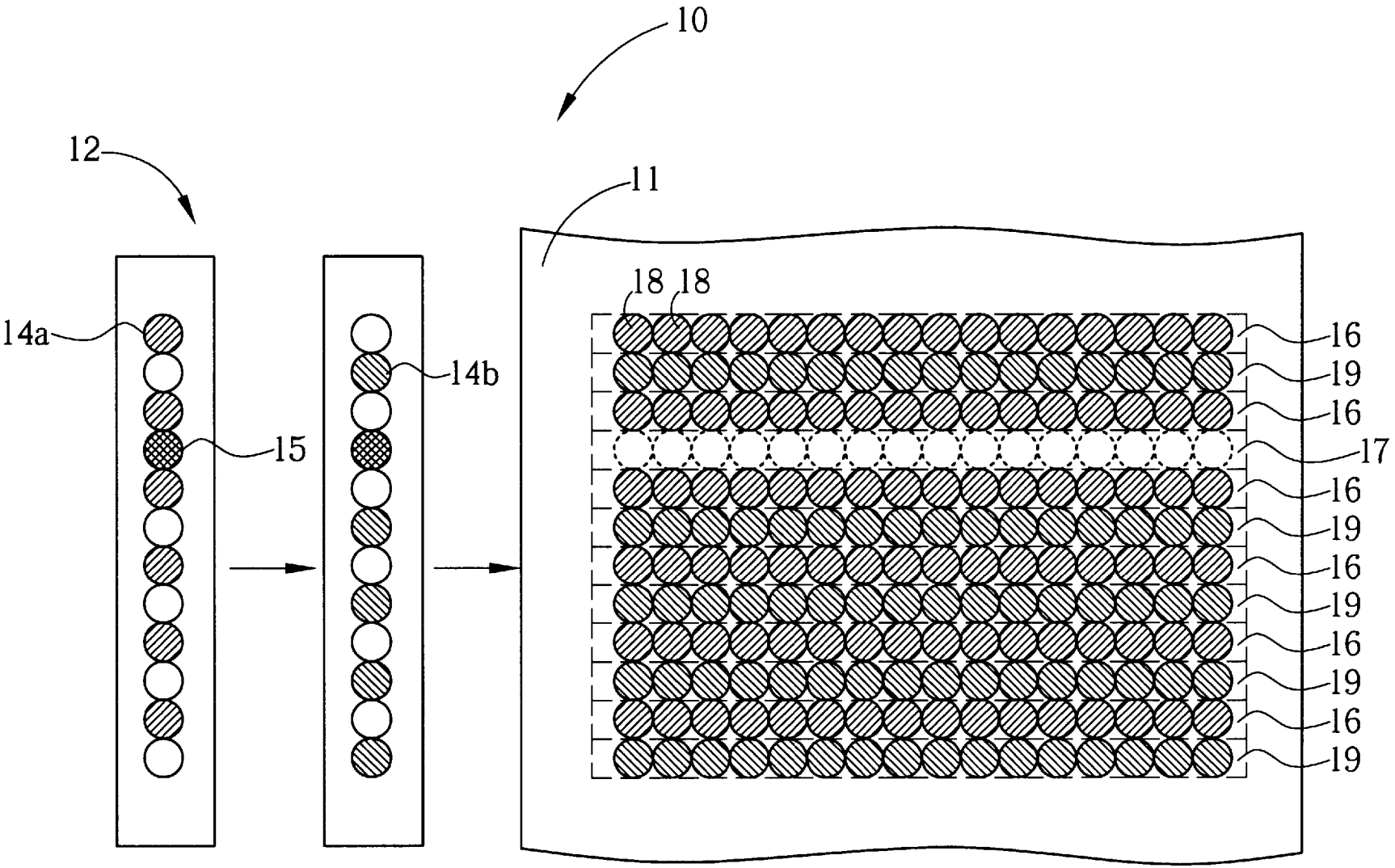
FIG. 3 is a printing diagram of the ink jet printer shown in FIG. 2 when having a malfunctioning nozzle.
Figure 4:
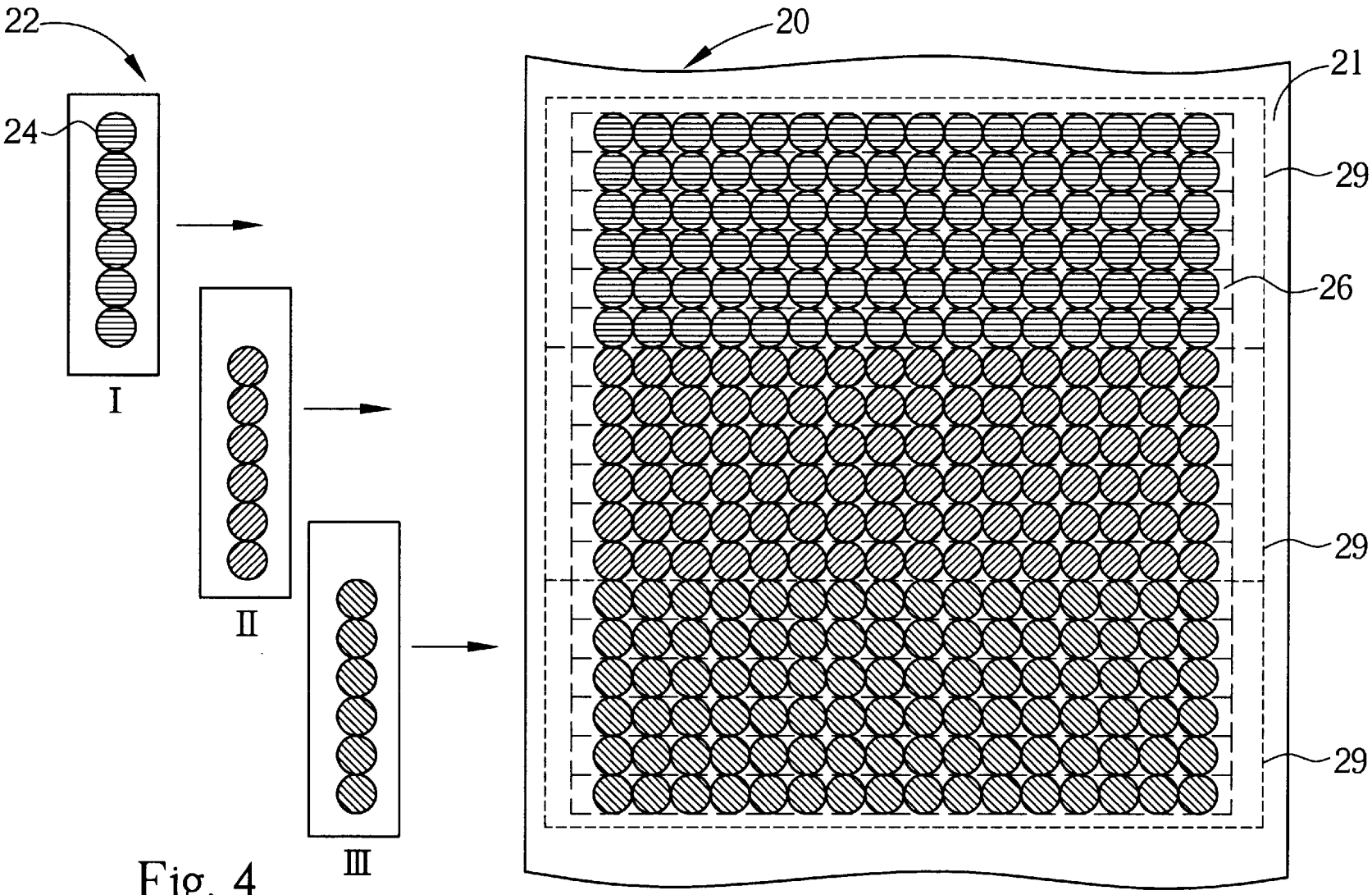
FIG. 4 is another printing diagram of a prior art ink jet printer when operating properly.

Please refer to FIG. 3 and FIG. 8. In contrast to the prior art shingling printing shown in FIG. 3, the preferred embodiment uses the nozzles 38 of the group of normal nozzles 40 to form the printing strips would be formed by the malfunctioning nozzle 39, so that the blank space 17, shown in FIG. 3, is not produced. In other words, the printing strips formed by the normal nozzles cover the area of the printing strips formed by the malfunctioning nozzle 39 on the document 32, and the printing effect when all nozzles work properly is still obtained.

In addition, the above mentioned positions (position I and position II) of the ink jet printing head 34 in the two printing processes differ by a distance of one nozzle. In fact, the positions of the ink jet printing head 34 in the two printing processes are capable of differing a distance of a plurality of (or odd numbers of) nozzles. The malfunctioning nozzle 39 is still replaced by the nozzles 38 of the group of normal nozzles 40. For example, as shown in FIG. 8, after finishing the first printing process, the document 32 can be moved a distance of three nozzles to perform the second printing process. Then the document 32 is moved a distance of three nozzles again to perform the third printing process. This way, the document 32 can be printed completely, and the blank space 17 shown in FIG. 3 is not produced.

Again, the present invention is not limited to selecting the group of normal nozzles 40 every other nozzle. Taking into consideration the distribution of the malfunctioning nozzles 39, a predetermined number of interval-spaced nozzles (such as selecting 1 nozzle every 2 nozzles, or selecting 2 adjacent nozzles every 2 nozzles) forms the group of normal nozzles 40 to perform printing. The group of normal nozzles 40 replaces the malfunctioning nozzles 39 in this way, too. Now the movement positioning of the ink jet printing head 34 in the two printing processes does not occur at the above mentioned distance of an odd number of nozzles. The only requirement is that the positions of the malfunctioning nozzles 39 are covered.

Figure 9:
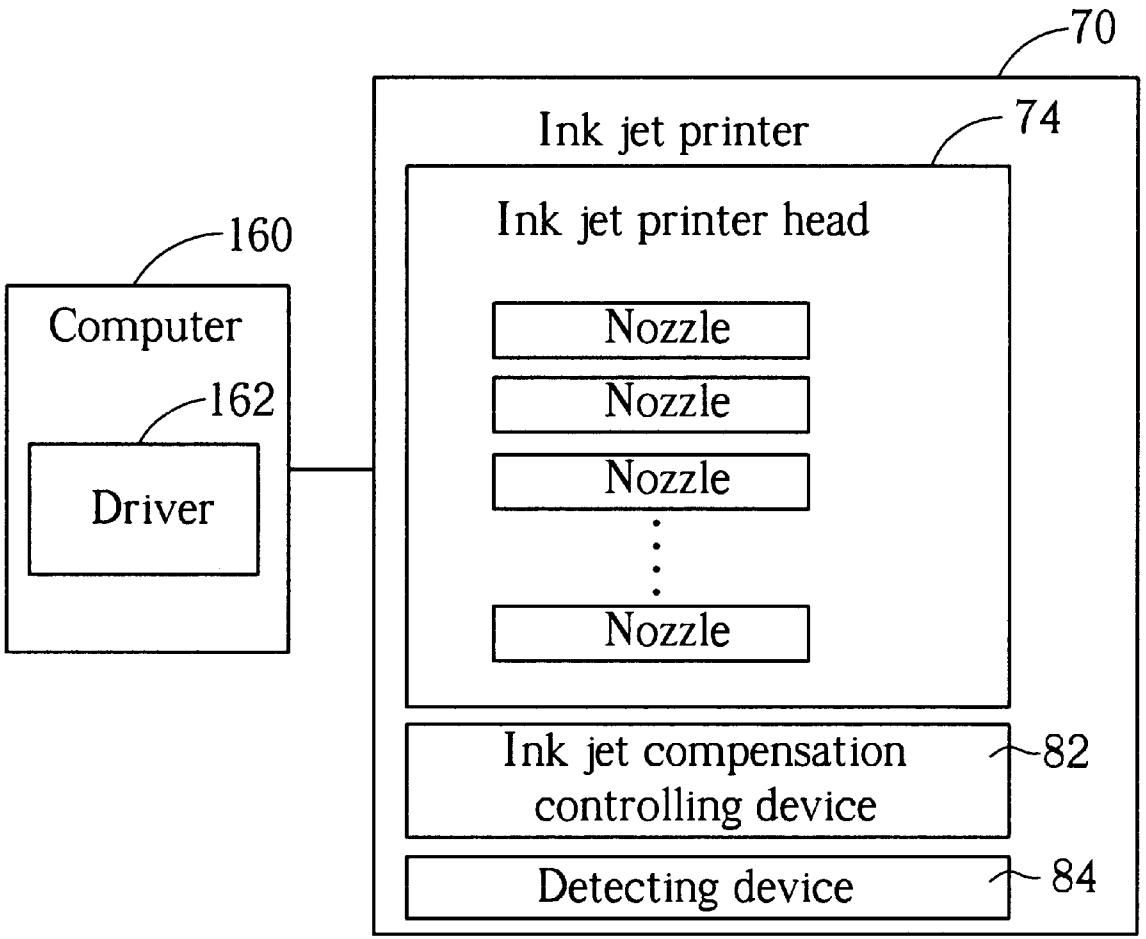
FIG. 9 is a function block diagram of a second preferred embodiment of the present invention ink jet printer.
Figure 10:
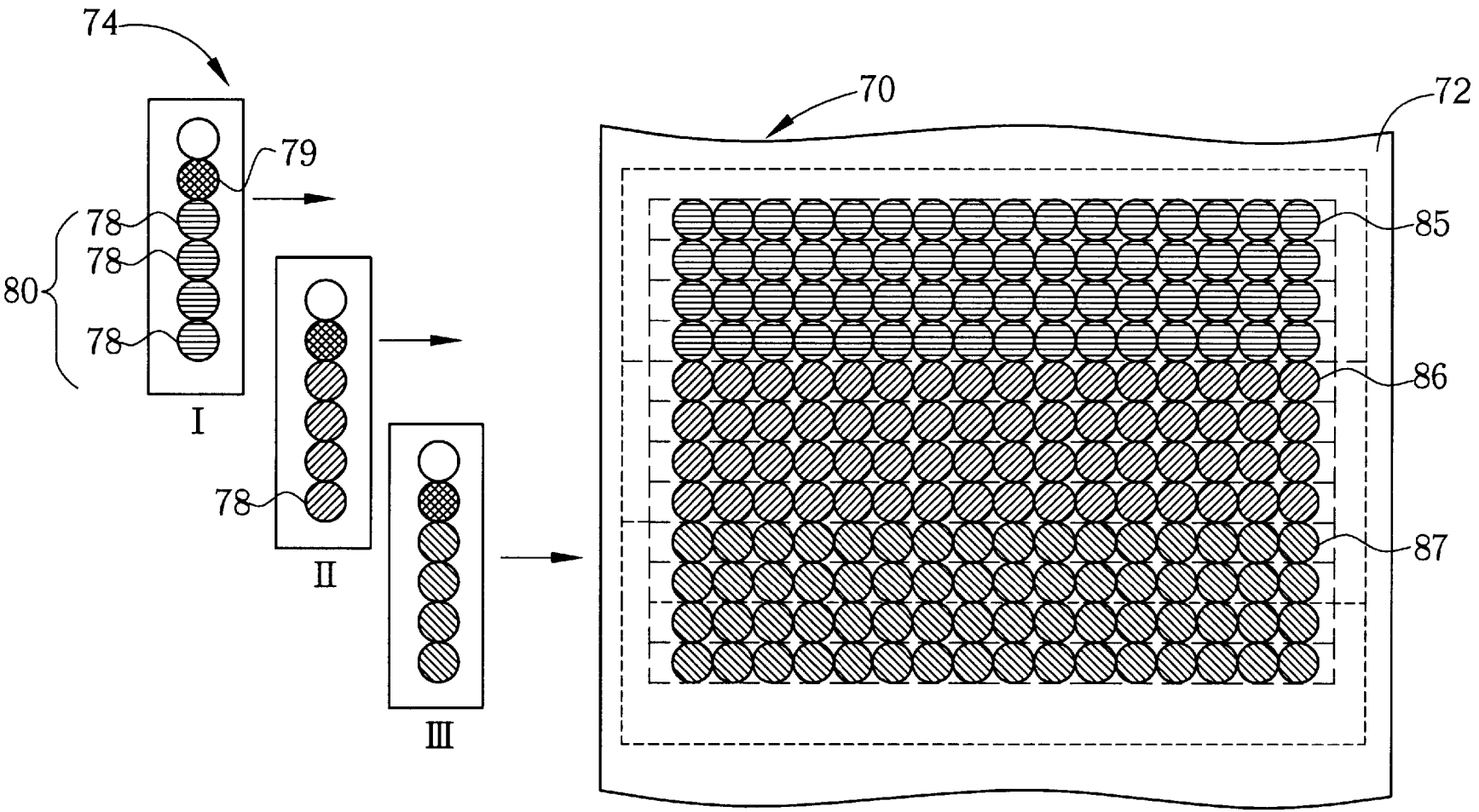
FIG. 10 is a printing diagram of the ink jet printer shown in FIG. 9.

Please refer to FIG. 9 and FIG. 10. FIG. 9 is a function block diagram of a second preferred embodiment of the present invention ink jet printer 70. FIG. 10 is a printing diagram of the ink jet printer 70 shown in FIG. 9. The main difference between the second preferred embodiment and the above mentioned first preferred embodiment is that when the detecting device 84 detects a malfunctioning nozzle 79, the second preferred embodiment selects a plurality of successively adjacent nozzles 78 to form the group of normal nozzles 80, not selecting interval-spaced nozzles to determine the group of normal nozzles 80, as the above mentioned embodiment does to achieve the objective of replacing the malfunctioning nozzle 79 with the group of normal nozzles 80.

As shown in FIG. 10, in performing the first printing process, the ink jet compensation controlling device 82 moves the document 72, so that the ink jet printing head 74 locates to a position I, and performs printing with the group of normal nozzles 80 (including 4 successively adjacent normal nozzles 78) to form the printing strips area 85. In the second printing process, the ink jet compensation controlling device 82 moves the document 72 or the ink jet printing head 74, so that the ink jet printing head 74 locates to a position II, and performs printing with the group of normal nozzles 80 to form the printing strips area 86. In the third printing process, the ink jet compensation controlling device 82 moves the document 72 or the ink jet printing head 74, so that the ink jet printing head 74 locates to a position III, and performs printing with the group of normal nozzles 80 to form the printing strips area 87. The printing strips areas 85, 86, and 87 are not interlaced. This way, the same printing result as that obtained when all nozzles are operating properly is obtained.

Figure 5:
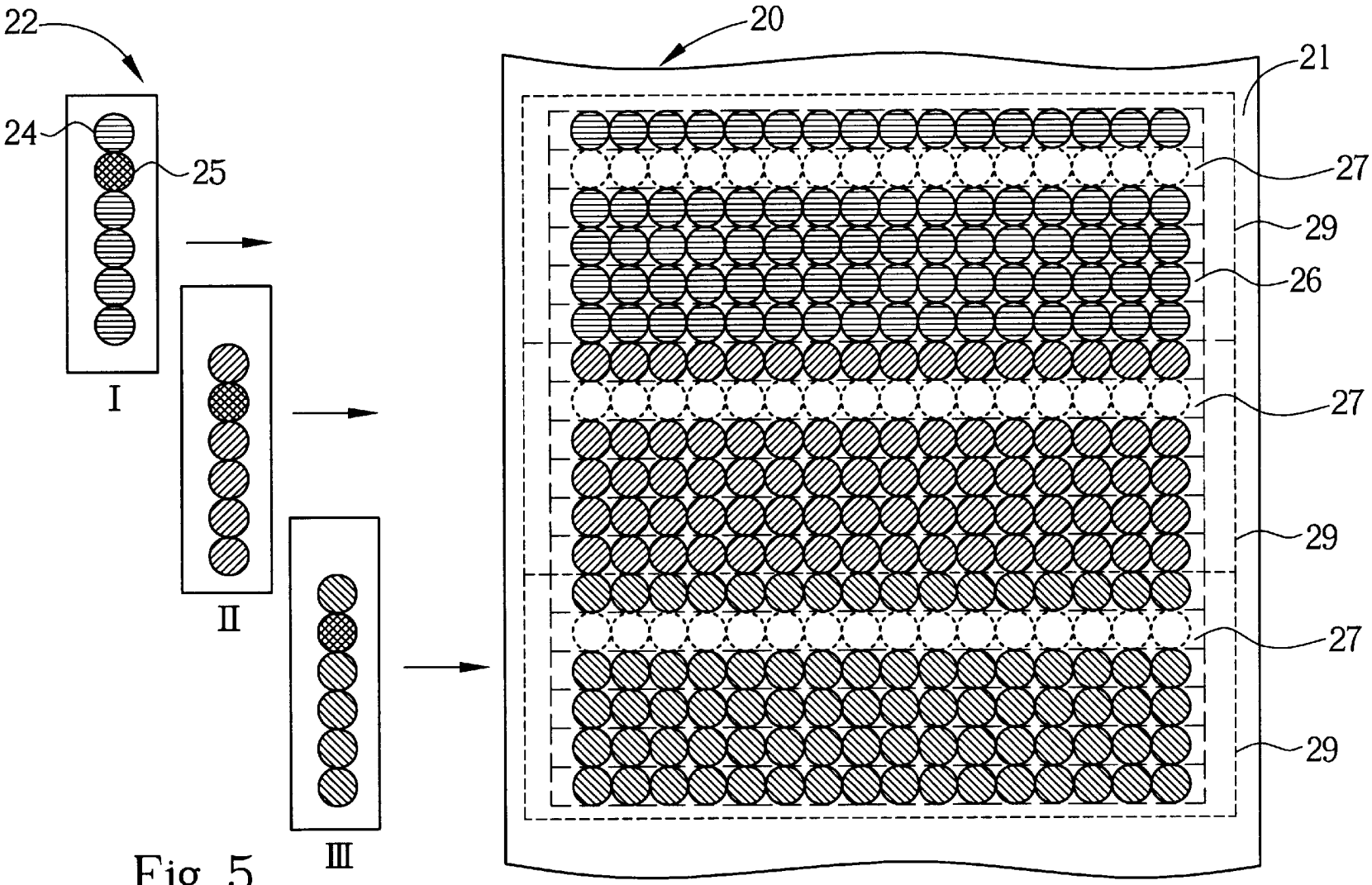
FIG. 5 is a printing diagram of the ink jet printer shown in FIG. 4 when having a malfunctioning nozzle.

Please refer to FIG. 5 and FIG. 10. In the contrast to the prior art area printing shown in FIG. 5, the preferred embodiment does not use the malfunctioning nozzle 79 to perform printing but uses the nozzles 78 of the group of normal nozzles 80 to form the printing strips that are conventionally formed by the malfunctioning nozzle 79, so that the blank space 27 shown in FIG. 5 is not produced, and the printing quality is improved.

Figure 11:
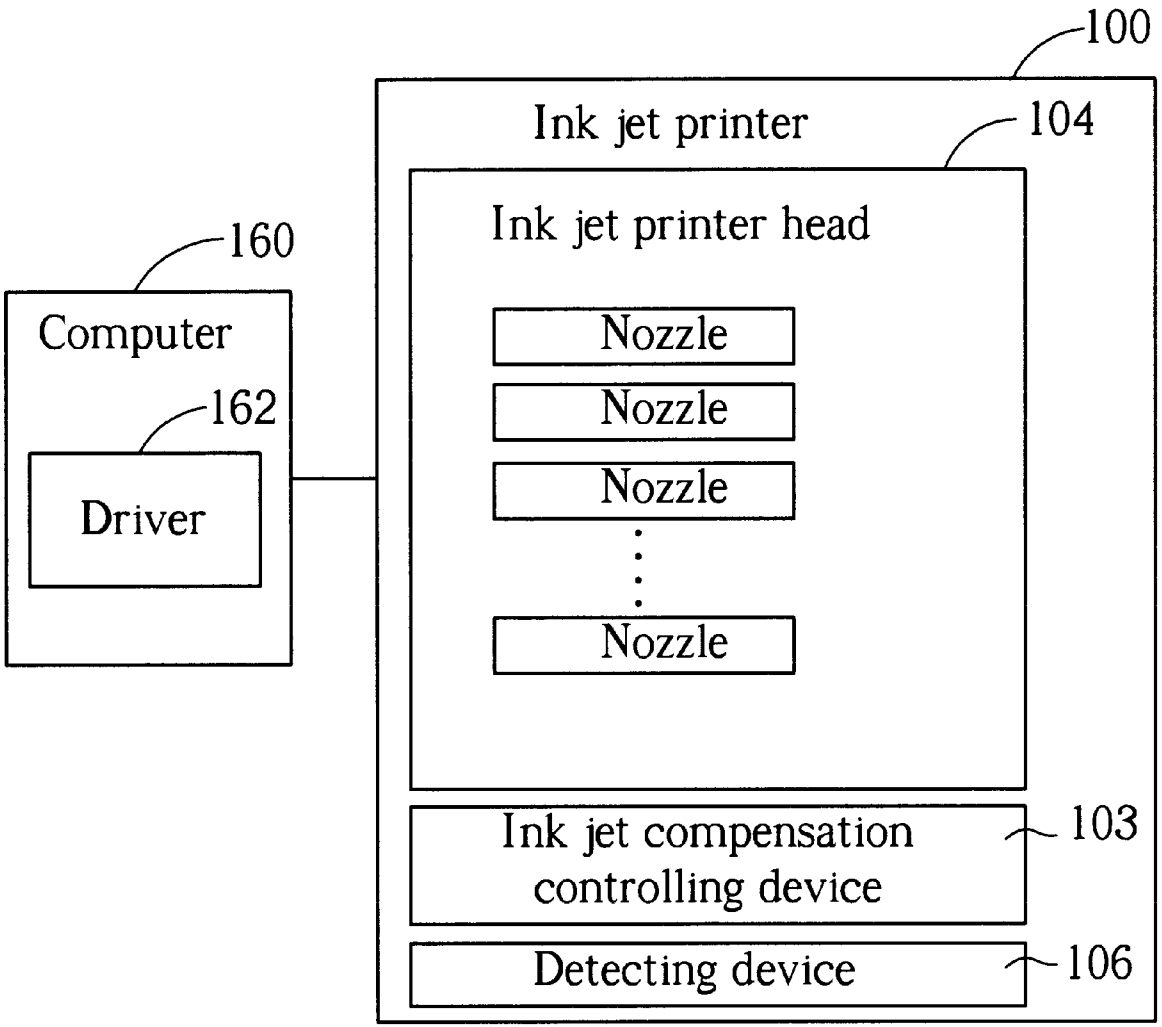
FIG. 11 is a function block diagram of a third preferred embodiment of the present invention ink jet printer.
Figure 12:
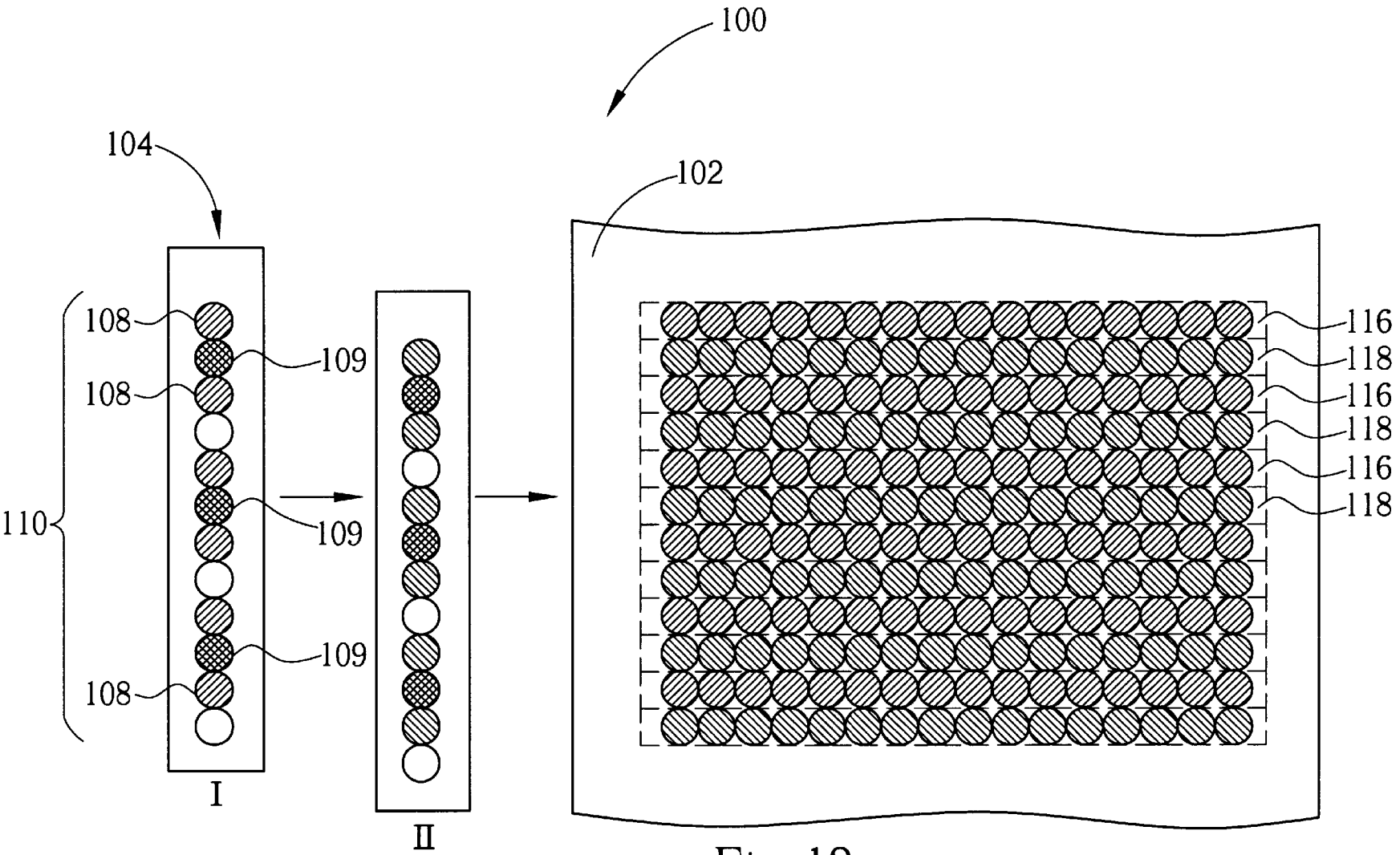
FIG. 12 is a first printing diagram of the ink jet printer shown in FIG. 11.
Figure 13:
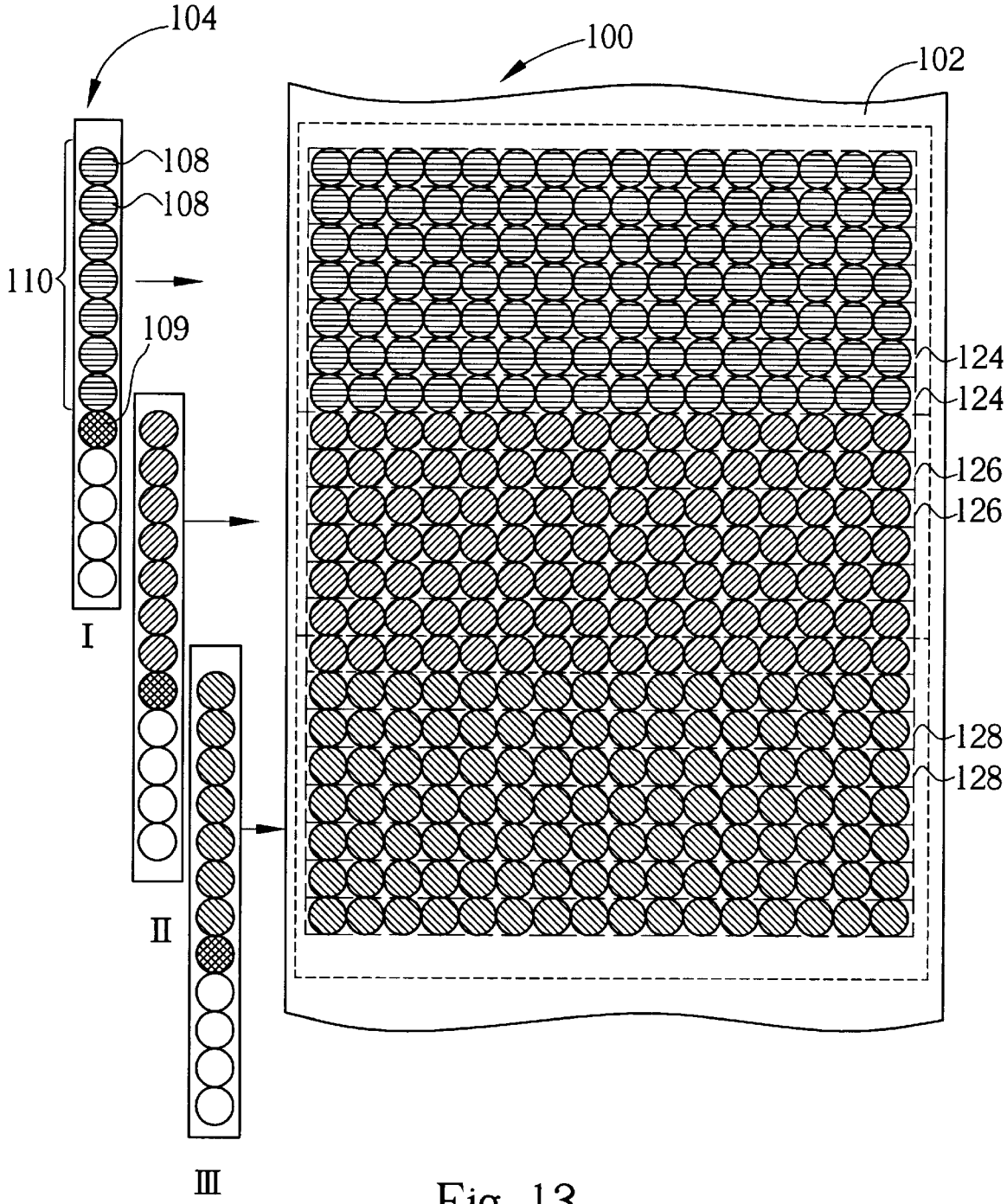
FIG. 13 is a second printing diagram of the ink jet printer shown in FIG. 12.

Please refer to FIG. 11 to FIG. 13. FIG. 11 is a function block diagram of a third preferred embodiment of the present invention ink jet printer 100. FIG. 12 is a first printing diagram of the ink jet printer 100. FIG. 13 is a second printing diagram of the ink jet printer 100. The difference between the ink jet printer 100 and the above preferred embodiments is that the ink jet compensation controlling device 103 does not perform printing by selecting fixed interval-spaced nozzles or selecting successively adjacent nozzles. It determines the printing method of the ink jet printer 100 according to whether the maximum successive adjacent normal nozzles is fewer than a predetermined number (such as half of the total number of the nozzles).

As shown in FIG. 12, the ink jet printing head 14 has three malfunctioning nozzles 109. The maximum successive adjacent normal nozzles of the ink jet printing head 104 is three, which is fewer than six, which is half of the total number of the nozzles, twelve. In this situation, the ink jet compensation controlling device 103 can select the group of normal nozzles 100 by interval-spaced selecting (such as selecting one nozzle every other nozzle), and move the relative position of the ink jet printing head 104 and the document 102, respectively, so that the ink jet printing head 104 locates to position I and position II to produce printing strips 116 and 118, respectively, to perform the printing job.

As shown in FIG. 13, if the malfunctioning nozzle is 109, the maximum successive adjacent normal nozzles of the ink jet printing head 104 is seven, which exceeds six, which is half of the total number of the nozzles, twelve. In this situation, the ink jet compensation controlling device 103 can select a plurality of (such as seven) successive adjacent nozzles to form the group of normal nozzles 110 and move the ink jet printing head 104 to position I, II, and III sequentially, to produce printing strips areas 124, 126, 128, respectively, to perform the printing job.

Figure 14:
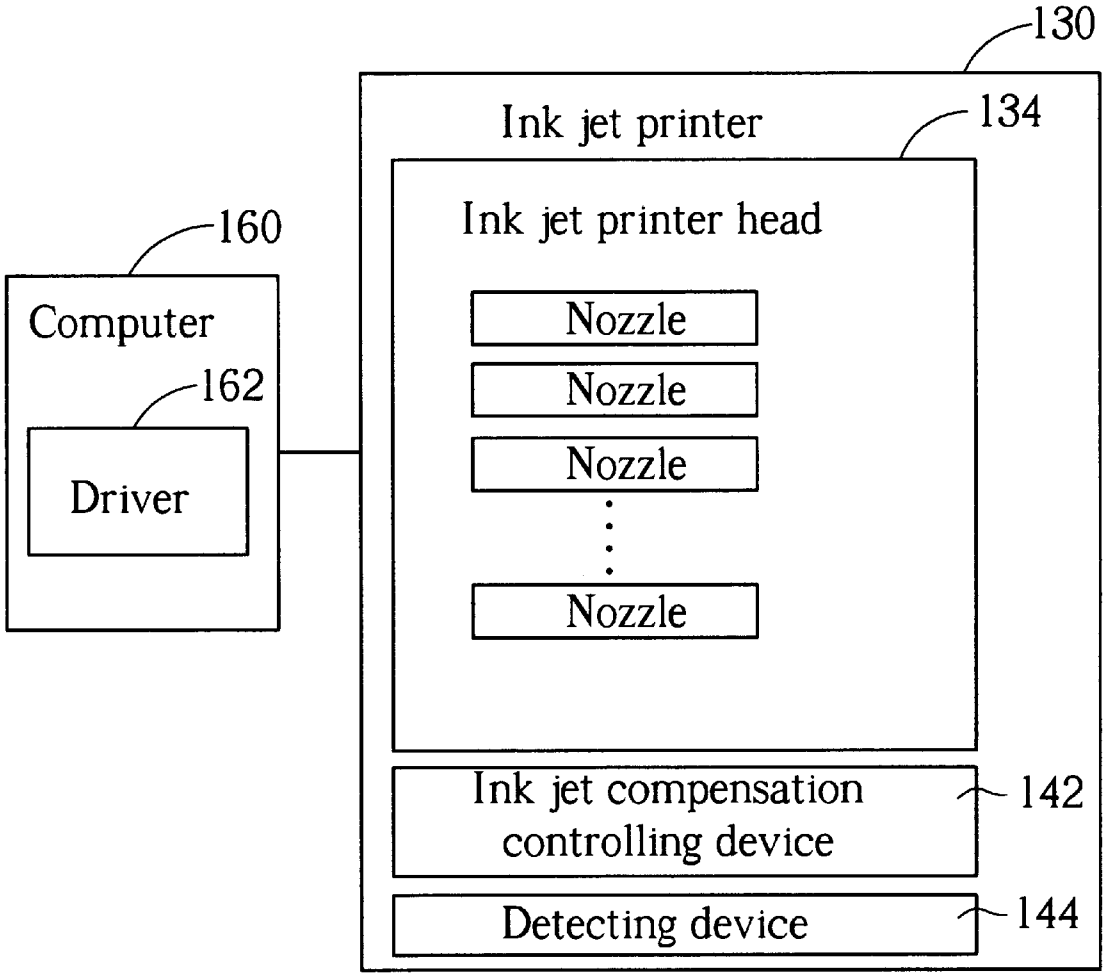
FIG. 14 is a function block diagram of a fourth preferred embodiment of the present invention ink jet printer.
Figure 15:
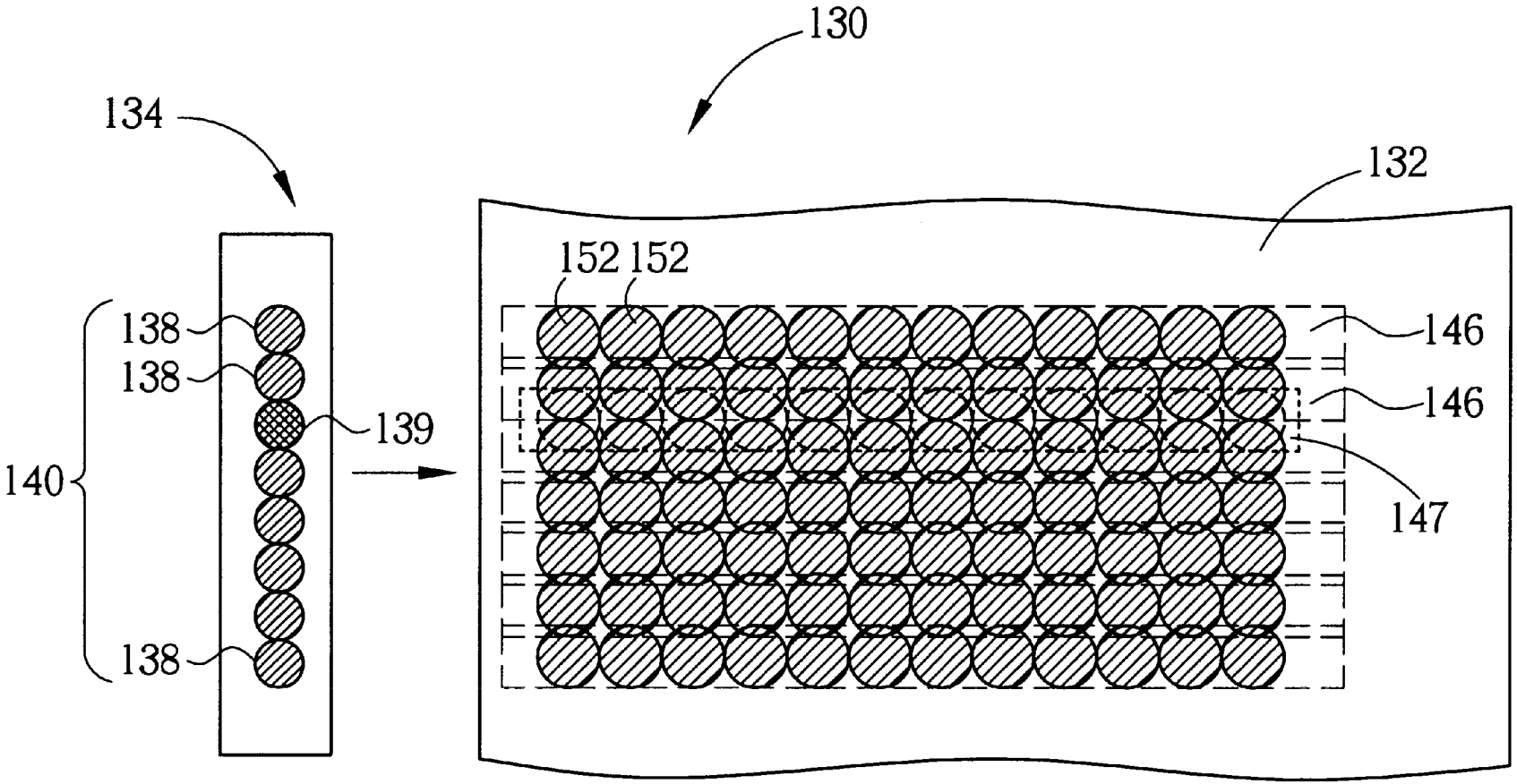
FIG. 15 is a printing diagram of the ink jet printer shown in FIG. 14.

Please refer to FIG. 14 and FIG. 15. FIG. 14 is a function block diagram of a fourth preferred embodiment of the present invention ink jet printer 130. FIG. 15 is a printing diagram of the ink jet printer 130 shown in FIG. 14. The preceding three preferred embodiments use the nozzles 38, 78, and 108 of the groups of normal nozzles 40, 80, and 110 to form the printing strips. The difference between the above mentioned printing compensation method and the fourth preferred embodiment is that the fourth embodiment enlarges an area of an ink jet point to achieve the printing compensation effect. As shown in FIG. 15, when the detecting device 144 detects the malfunctioning nozzle 139, the ink jet compensation controlling device 142 controls ink jetted from the normal nozzles 138 of the group of normal nozzles 140 to enlarge the area of the ink jet points 152. In this manner, the printing strips formed by the normal nozzles 138 cover the printing strips that would original be formed by the malfunctioning nozzle 139 on the document 132, so that the blank space is not clear, or has even disappeared.

Additionally, the above preferred embodiment is described for a plurality of nozzles arranged in a row. However, it should be obvious to one skilled in the art that the present invention printing compensation method is suitable for a situation of a plurality of nozzles arranged in a plurality of rows. Actually, any method using normal nozzles to replace malfunctioning nozzles to print by changing the printing method meets the spirit of the present invention.

In contrast with the prior art ink jet printer 10, the present invention ink jet printer has the ability of compensating for malfunctioning nozzles. When there is a malfunctioning nozzle in the ink jet printing head, other properly operating nozzles are used to perform the printing job. Therefore, the user does not change the ink jet printing head of the ink jet printer to achieve the objective of keeping the printing quality, thus reducing the servicing cost, because the nozzles in the ink jet printer operate improperly.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An ink jet printer for printing a document, the ink jet printer comprising:

an ink jet printing head comprising a plurality of nozzles;

an ink jet compensation controlling device for driving the ink jet printing head so that the nozzles are capable of forming a plurality of linear printing strips on the document, each printing strip comprising a plurality of ink jet points; and a detecting device for detecting a working status of the nozzles;

wherein when the nozzles work normally, the ink jet compensation controlling device uses the nozzles to form the printing strips, and when the detecting device detects at least a malfunctioning nozzle in the nozzles, the ink jet compensation controlling device selects a group of normal nozzles according to the position of the malfunctioning nozzle, the group of normal nozzles comprising a plurality of normal nozzles that excludes the malfunctioning nozzle, and the ink jet compensation controlling device controls the group of normal nozzles to form corresponding printing strips on the document, the printing strips formed by the group of normal nozzles covering an area of the printing strips that is formed by the malfunctioning nozzle if the malfunctioning nozzle is working.

2. The ink jet printer of claim 1 wherein the ink jet compensation controlling device changes a relative position of the document with the printing head in a direction that is perpendicular to the printing strips so that the normal group of nozzles form the printing strips that are formed by the malfunctioning nozzle if the malfunctioning nozzle works.

3. The ink jet printer of claim 2 wherein the relative position of the document and the printing head is capable of being changed by changing the position of the printing head.

4. The ink jet printer of claim 2 wherein the relative position of the document and the printing head is capable of being changed by changing the position of the document.

5. The ink jet printer of claim 1 wherein the ink jet compensation controlling device executes a plurality of printing processes to print the document, and in at least one of the printing processes, a nozzle from the group of normal nozzles forms the printing strips that are formed by the malfunctioning nozzle if the malfunctioning nozzle work is working.

6. The ink jet printer of claim 1 wherein when the detecting device detects at least a malfunctioning nozzle in the plurality of nozzles, the ink jet compensation controlling device selects the group of normal nozzles by selecting a predetermined number of interval-spaced nozzles and controls the printing head to execute the plurality of printing process so that the group of normal nozzles form the plurality of printing strips on the document, the printing strips in each printing process interlaced with printing strips in another printing process.

7. The ink jet printer of claim 1 wherein when the detecting device detects at least a malfunctioning nozzle in the plurality of nozzles, the ink jet compensation controlling device selects a plurality of successively adjacent nozzles to form the group of normal nozzles and controls the printing head to execute the plurality of printing processes so that the group of normal nozzles form the plurality of printing strips on the document, the printing strips in each printing process not interlaced with printing strips in another printing process.

8. The ink jet printer of claim 1 wherein when the detecting device detects that maximum successive adjacent nozzles of the printing head are fewer than a predetermined number, the ink jet compensation controlling device selects the group of normal nozzles by selecting a predetermined number of interval-spaced nozzles, and when the detecting device detects that the maximum successive adjacent nozzles of the printing head exceed the predetermined number, the ink jet compensation controlling device selects a plurality of successively adjacent nozzles to form the group of normal nozzles.

9. The ink jet printer of claim 1 wherein when the detecting device detects that there is a malfunctioning nozzle in the plurality of nozzles, the ink jet compensation controlling device controls the capacity of ink jetted by a nozzle in the group of normal nozzles to enlarge the area of an ink jet point formed by the nozzle.

10. The ink jet printer of claim 1 wherein the plurality of nozzles are arranged in a row.

11. The ink jet printer of claim 1 wherein the plurality of nozzles are arranged in a plurality of parallel rows, and each parallel row comprises a plurality of nozzles.

12. The ink jet printer of claim 1 wherein the ink jet printer is electrically connected to a computer, and the computer comprises a driver to control the ink jet compensation controlling device so that the printing head uses the group of normal nozzles to print the document.

13. An ink jet printer for printing a document, the ink jet printer comprising:

an ink jet printing head comprising a plurality of nozzles;

an ink jet compensation controlling device for driving the ink jet printing head so that the nozzles are capable of forming a plurality of linear printing strips on the document, each printing strip comprising a plurality of ink jet points; and a detecting device for detecting a working status of the nozzles;

wherein when the nozzles work normally, the ink jet compensation controlling device uses the nozzles to form the printing strips, and when the detecting device detects at least a malfunctioning nozzle in the nozzles, the ink jet compensation controlling device selects a group of normal nozzles according to the position of the malfunctioning nozzle, the group of normal nozzles excluding the malfunctioning nozzle, and adjusts a position of the print head with respect to the document to process printing.

14. The ink jet printer of claim 13 wherein when an interval spacing of the nozzles in the group of normal nozzles is a single nozzle, the ink jet compensation controlling device moves the relative position of the printing head with respect to the document by an odd number of nozzles to process printing.

15. The ink jet printer of claim 13 wherein when an interval spacing of the nozzles in the group of normal nozzles is a plurality of nozzles, the ink jet compensation controlling device moves the relative position of the printing head with respect to the document by a predetermined distance to process printing.

16. The ink jet printer of claim 13 wherein when the distribution of the nozzles in the group of normal nozzles is a plurality of successive nozzles, the ink jet compensation controlling device moves the relative position of the printing head with respect to the document by a distance that at least equals a width of the group of normal nozzles.

* * * * *